US006912879B1

(12) United States Patent
Yu

(10) Patent No.: US 6,912,879 B1
(45) Date of Patent: Jul. 5, 2005

(54) LOCKING APPARATUS COMBINED WITH A FASTENER FOR CONTROLLING LOCKING/UNLOCKING THEREOF

(76) Inventor: Chun-Te Yu, No.41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 0 days.

(21) Appl. No.: 10/809,489

(22) Filed: Mar. 26, 2004

(51) Int. Cl.[7] ..... E05B 73/00
(52) U.S. Cl. ..... 70/58; 70/284; 70/285; 70/DIG. 63
(58) Field of Search ..... 70/21, 58, 284, 70/285, DIG. 63

(56) References Cited

U.S. PATENT DOCUMENTS 1,377,737 A * 5/1921 Stosech ..... 70/284
4,649,723 A * 3/1987 Appelbaum ..... 70/63
4,912,950 A * 4/1990 Crowle ..... 70/58
5,193,368 A * 3/1993 Ling ..... 70/30
5,237,842 A * 8/1993 Rasch et al. ..... 70/285
5,307,544 A * 5/1994 Quarberg et al. ..... 24/633
5,692,403 A * 12/1997 Ling ..... 70/312
5,873,505 A * 2/1999 Sovitski ..... 224/576
5,934,120 A * 8/1999 Kuo ..... 70/312
6,016,675 A * 1/2000 Te ..... 70/312
6,684,667 B2 * 2/2004 Young ..... 70/18

* cited by examiner

*Primary Examiner*—Lloyd A. Gall
(74) *Attorney, Agent, or Firm*—Troxell Law Office, PLLC

(57) ABSTRACT

A locking apparatus combined with a fastener to control locking/unlocking thereof. The locking apparatus includes a housing and a female fastener. The housing defines a cavity in which a numeral wheel locking unit is mounted. The female fastener defines a cavity in which a controlling unit is disposed. In a locked state, the locking unit and the controlling unit respectively detain a first end and a second end of a male fastener. The locking unit includes a valve block which can be horizontally and vertically displace to release the first end of the male fastener. The controlling unit includes a rotary section, a reactor and a driven unit which are disposed on the rotary section. A key can be inserted into the rotary section to drive and rotate the rotary section, making the reactor and the driven unit rotated into an unlocked state to release the second end of the male fastener.

3 Claims, 8 Drawing Sheets

LOCKING APPARATUS COMBINED WITH A FASTENER FOR CONTROLLING LOCKING/UNLOCKING THEREOF

BACKGROUND OF THE INVENTION

The present invention is related to a locking apparatus meeting the regulation of U.S. customs, and more particularly to a locking apparatus with both numeral wheel locking unit and key-driven locking unit which are combined with a fastener to control locking/unlocking thereof.

The conventional locking apparatuses include numeral system and key-driven system. The numeral system includes numeral wheel type and press key type. These locking apparatuses are widely applied to various fields. For example, Taiwanese Patent Nos. 32470 and 46563 and Taiwanese Patent Publication No. 498918, entitled "hanging lock structure (5)" and Taiwanese Patent Publication No. 369068, entitled "hanging lock structure" respectively disclose locking apparatuses pertaining to numeral system and key-driven system applicable to baggage case or suitcase. Taiwanese Patent Publication No. 188528, entitled "belt numeral lock" and Taiwanese Patent Publication No. 457855, entitled "fastener structure of fastening strap of an appliance" disclose numeral locks combined with fastening straps of baggage case or suitcase.

Practically, it is known that when checked by U.S. customs workers, in case it is found the customs workers that the contents of the baggage case or suitcase are suspicious, the customs workers are authorized by U.S. government to forcedly break off the lock of the baggage case or suitcase and open the same for checking the contents. The damaged lock will be a loss of a user and will lead to trouble and inconvenience to the user, especially during travel.

In order to improve the above situation, U.S. government and customs regulate that the lock manufacturers must provide a standard key for the customs for opening all the locks manufactured by the manufacturers. According to this regulation, there are six lock manufacturers all over the world (including two manufacturers in Taiwan) who are allowed to manufacture such locks. The applicant is one of the two manufacturer in Taiwan. When meeting the above regulation, some issues must be considered in designing and manufacturing such locks. For example, it is considered how to combine the numeral wheel locking unit and key-driven locking unit in the locking apparatus to together control the lock hook thereof without affecting or interfering with the original operation and function of the locking apparatus. Also, the manufacturers must consider the cooperation of the two locking units and the state of one of the locking units when the other is operated. These issues are not discussed in the above Patents.

SUMMARY OF THE INVENTION

It is therefore a primary object of the present invention to provide a locking apparatus combined with a fastener to control locking/unlocking thereof. The locking apparatus meets the regulation of U.S. customs, including a housing and a female fastener. The housing defines a cavity in which a numeral wheel locking unit is mounted. The female fastener defines a cavity in which a key-driven controlling unit is disposed. In a locked state, the locking unit and the controlling unit respectively detain a first end and a second end of a male fastener. The locking unit includes a lock core and a valve block. When the numeral wheels are operated to a set number, the lock core can be freely axially moved, whereby the valve block can be horizontally and vertically displaced to release the first end of the male fastener. The controlling unit includes a driven unit. A key can be inserted into the controlling unit to drive and rotate the driven unit into an unlocked state to release the second end of the male fastener.

It is a further object of the present invention to provide the above locking apparatus in which the locking unit includes a resilient member for always supporting the valve block and permitting the valve block to be pressed to lever a restricting section so as to release the second end of the male fastener from detention.

It is still a further object of the present invention to provide the above locking apparatus in which the restricting section is pivotally connected with the housing and rotatable within a set range. The restricting section includes an arm, whereby when the restricting section is levered, the arm detains the first end of the male fastener or not.

It is still a further object of the present invention to provide the above locking apparatus in which the controlling unit includes a rotary section and a reactor disposed on the rotary section. When a key is inserted into the rotary section to rotate the same, the reactor is swung in a direction perpendicular to the axis of the rotary section to release the second end of the male fastener.

The present invention can be best understood through the following description and accompanying drawings wherein:

BRIEF DESCRIPTION OF THE DRAWINGS

FIG. 6-1 shows a modified embodiment of the controlling unit mounted in the female fastener;

DETAILED DESCRIPTION OF THE PREFERRED EMBODIMENTS

Figure 1:
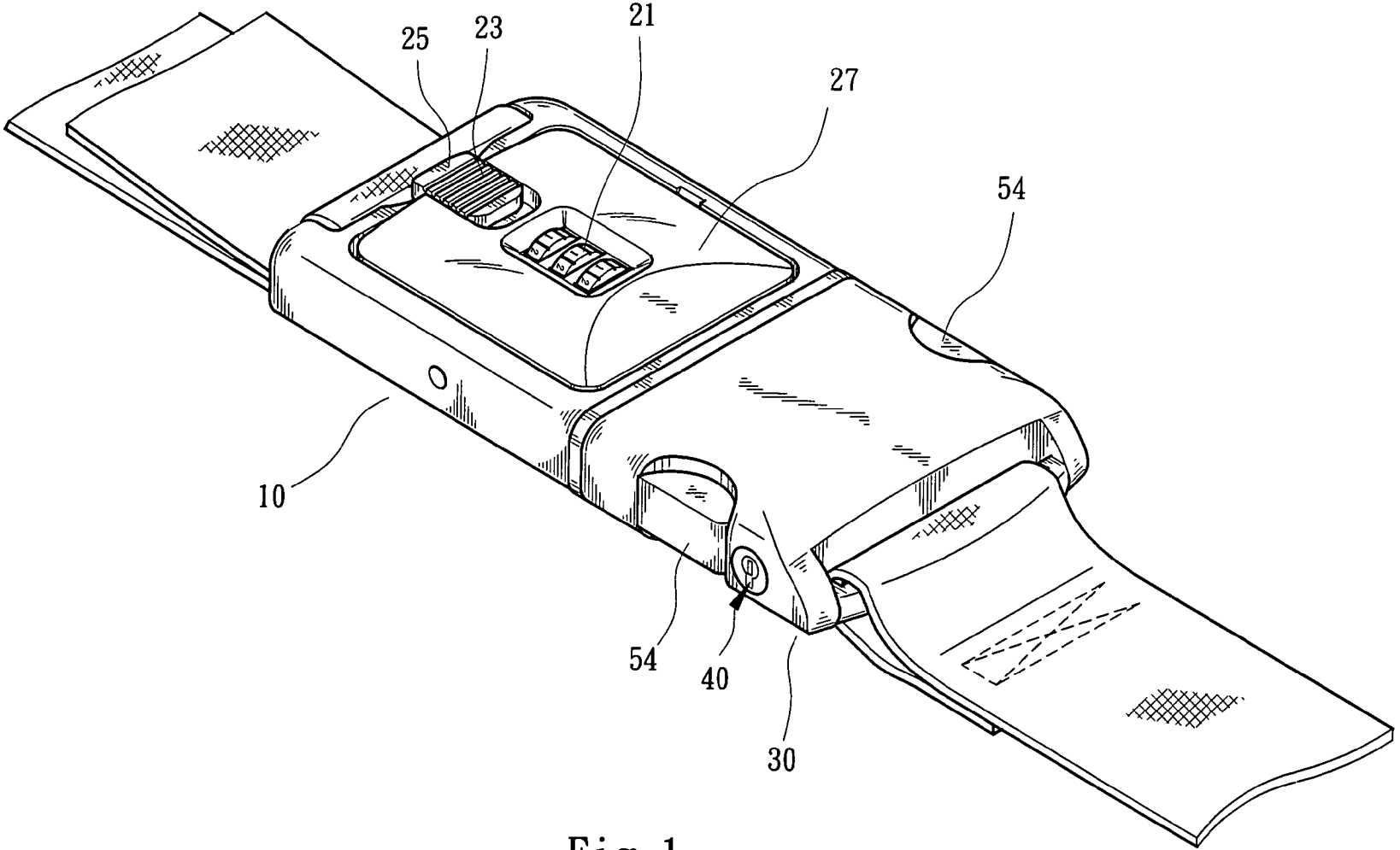
FIG. 1 is a perspective assembled view of a first embodiment of the present invention.
Figure 2:
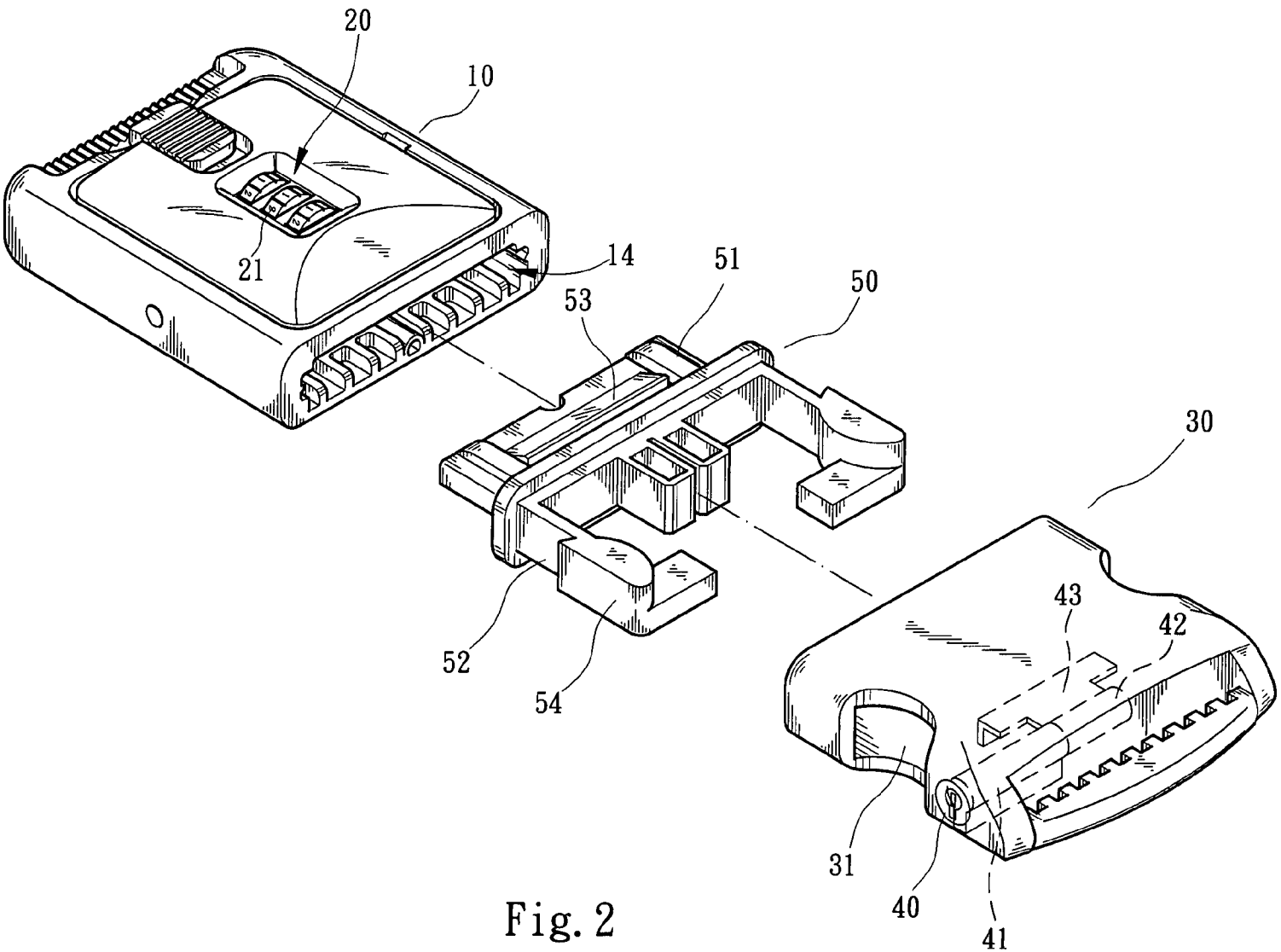
FIG. 2 is a perspective exploded view according to FIG. 1.
Figure 3:
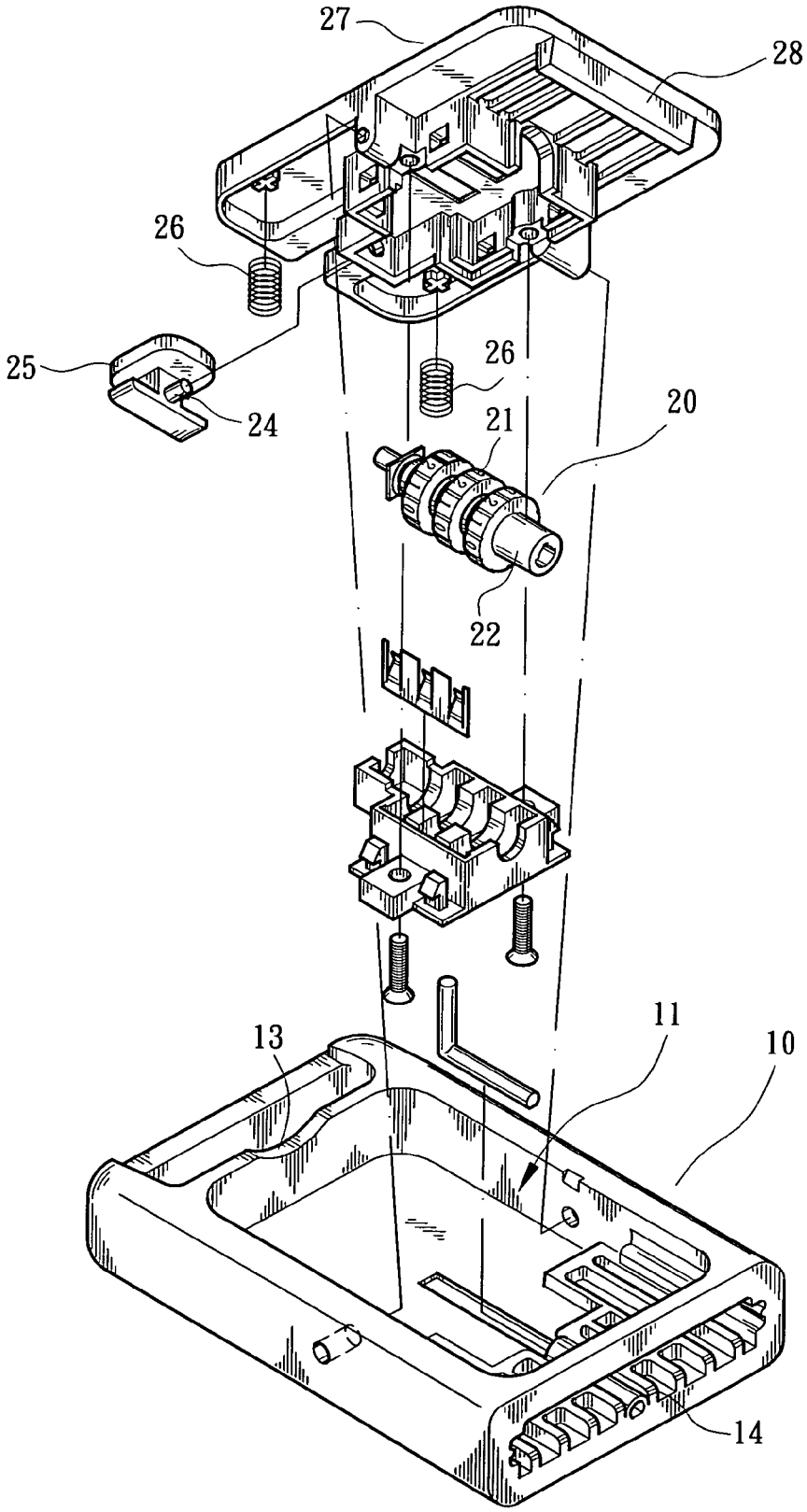
FIG. 3 is a perspective exploded view of the housing of FIG. 2.

Please refer to FIGS. 1, 2 and 3. The present invention includes a housing 10 and a female fastener 30. The housing 10 defines a cavity 11 in which a numeral wheel locking unit 20 is mounted. The female fastener 30 defines a cavity 31 in which a key-driven controlling unit 40 is disposed. In a preferred embodiment, the numeral wheel locking unit 20 is a standard numeral lock model which includes multiple numeral wheels 21 and a lock core 22 combined therewith. Each numeral wheel 21 partially protrudes from the housing 10 for a user to turn. When the numeral wheels 21 are turned to a set number, the lock core 22 is permitted to freely axially move. (This pertains to prior art and will not be further described hereinafter.)

A fixed end 24 of a valve block 23 is connected with the head section of the lock core 22. When the numeral wheel locking unit 20 is in an unlocked state, the lock core 22 is movable along with the valve block 23. A resilient member 26 is disposed on lower side of the fixed end 24 to always support the valve block 23 in upper section of the cavity 11. The valve block 23 can be perpendicularly displaced. The valve block 23 has a free end 25 opposite to the fixed end 24. The free end 25 rides on a wall 13 of the housing 10. In the unlocked state, the free end 25 can be selectively disengaged from the wall 13 or not.

A restricting section 27 is pivotally connected with the housing 10 and can be rotated within a set range. The restricting section 27 includes an arm 28 for detaining a male fastener 50. When the restricting section 27 is rotated, the arm 28 can release the male fastener 50. (This will be further described hereinafter.)

Referring to FIG. 2, the male fastener 50 includes a first end 51, a shoulder section 53 formed on the first end 51 and a second end 52 having two legs 54 which can be detained by the female fastener 30. The second end 52 has a form of a suspension arm. The legs 54 can be pressed toward each other. The first end 51 can be inserted into an opening 14 of the housing 10, whereby the arm 28 of the restricting section 27 can grasp the shoulder section 53 of the first end 51 as shown in FIG. 4.

In the first embodiment as shown in FIGS. 1 and 2, the controlling unit 40 is disposed in the cavity 31 of the female fastener 30. The controlling unit 40 includes a rotary section 41. A key can be inserted into the rotary section 41 to drive and rotate the rotary section 41. A reactor 42 is mounted on the rotary section 41 and connected with a driven unit 43. The driven unit 43 perpendicularly outward protrudes from the rotary section 41 and the reactor 42. The reactor 42 and the driven unit 43 are rotatable along with the rotary section 41. When the second end 52 of the male fastener 50 is detained by the female fastener 30, the driven unit 43 is positioned between the legs 54 of the second end 52, whereby the second end 52 cannot be pressed. When the rotary section 41 is rotated by the key, the driven unit 43 leaves this position, permitting the second end 52 to be pressed.

Figure 4:
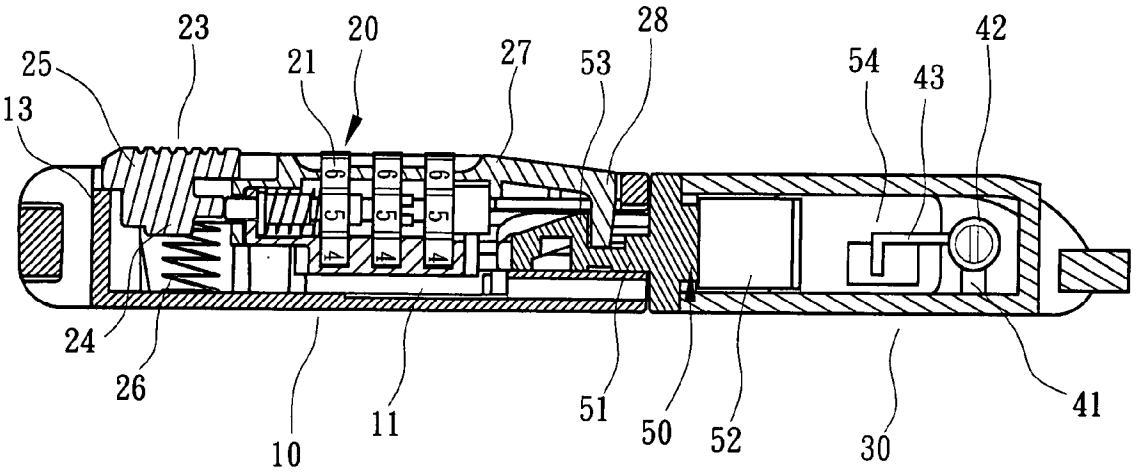
FIG. 4 is a sectional view according to FIG. 1.
Figure 5:
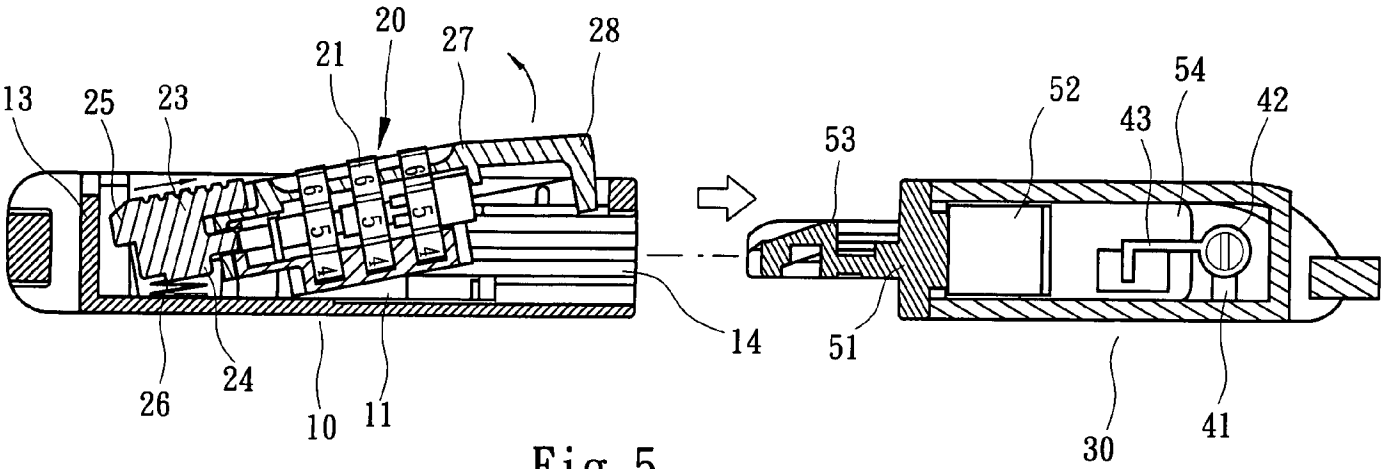
FIG. 5 is a sectional view showing that the numeral wheel locking unit of the present invention is operated into an unlocked state.

Referring to FIGS. 4 and 5, when the numeral wheels 21 are turned to a set number, the lock core 22 can be axially displaced. Accordingly, the valve block 23 can be operated to horizontally displace to make the free end 23 of the valve block 23 disengaged from the wall 13 of the housing 10. The valve block 23 can be vertically pressed, whereby the restricting section 27 provides a leverage effect to force the arm 28 disengaged from the shoulder section 53 of the first end 51 of the male fastener. Accordingly, the male fastener 50 is released from the detention of the housing 10 and can be freely extracted from the cavity 11 thereof as shown in FIG. 5.

Figure 6:
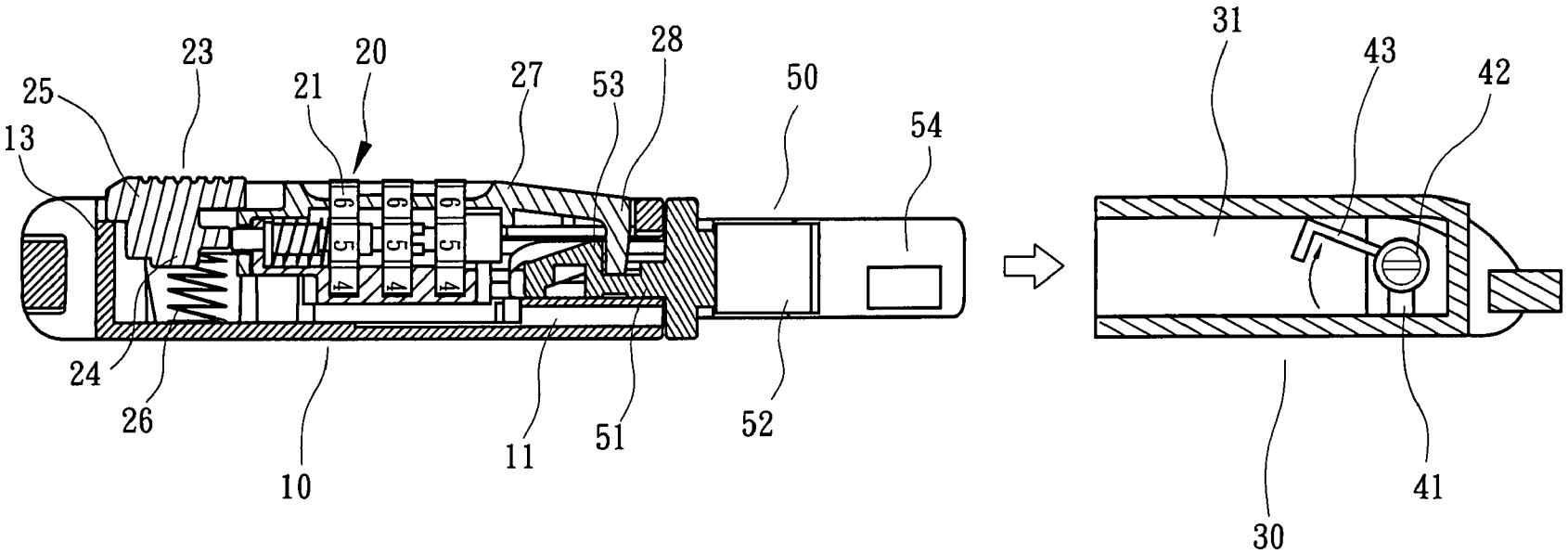
FIG. 6 is a sectional view showing that the controlling unit of the present invention is operated into an unlocked state.
Figures 1, 6:
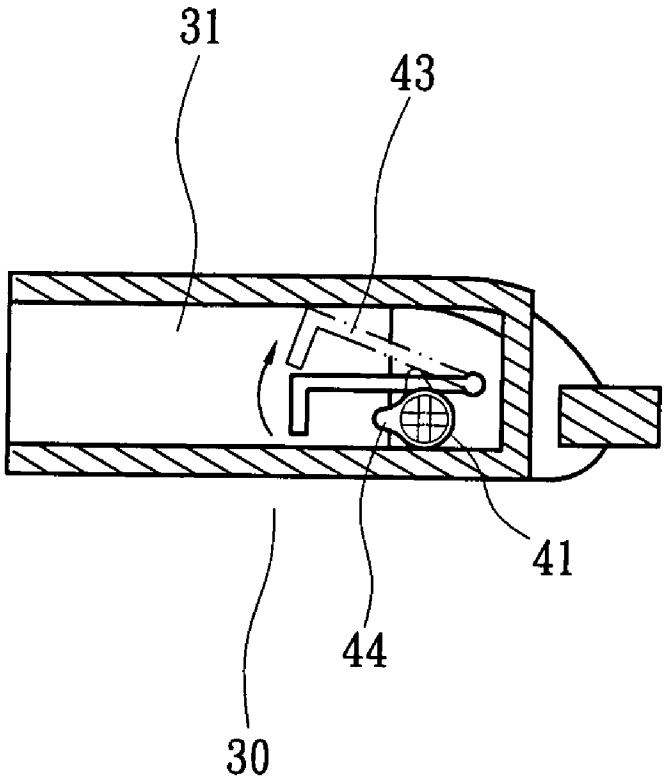

FIG. 1 shows a locked state of the present invention. After the key enters the rotary section 41 of the controlling unit 40, the rotary section 41 can be turned by the key. At this time, the reactor 42 and the driven unit 43 are moved along with the rotary section 41. The driven unit 43 is moved from the position between the legs 54 of the second end 52 of the male fastener to a position as shown in FIG. 6. Therefore, the legs 54 can be pressed toward each other and released from the detention of the female fastener 30 as shown in FIG. 6.

FIG. 6 shows that the valve block 23 and the arm 28 of the restricting section 27 are positioned in a locked position. The numeral wheels 21 of the locking unit 20 are not rotated to the set unlocking number. However, a customs worker can use a standard key to drive the controlling unit 40 and release the reactor 42 and the driven unit 43 from detention. FIG. 6-1 shows a modified embodiment of the controlling unit 40 installed in the female fastener 30. The rotary section 41 of the controlling unit 40 has a cam 44. When the rotary section 41 is driven and rotated by the key, the cam 44 pushes the driven unit 43 to angularly displace and release the legs 54 of the second end 52 of the male fastener as shown by phantom line of FIG. 6-1.

Figure 7:
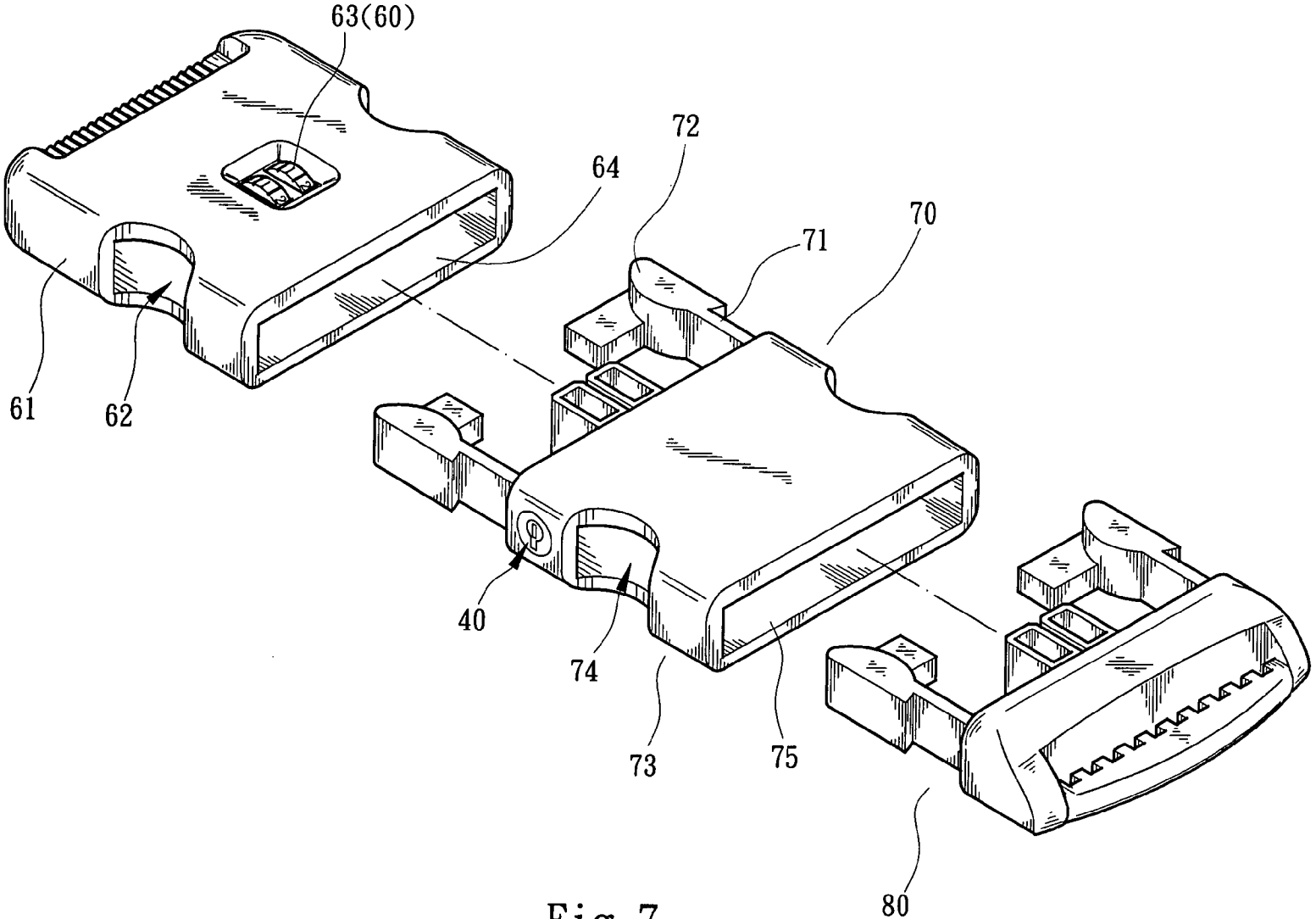
FIG. 7 shows a second embodiment of the present invention.

FIG. 7 shows a second embodiment of the present invention, in which the structure of the numeral wheel locking unit is modified and denoted by reference number 60. The locking unit 60 is disposed in a cavity 62 defined by a housing 61. The cavity 62 has an opening 64. FIG. 7 shows that a numeral wheel 63 is mounted in the cavity 62. The axis of the numeral wheel 63 is perpendicular to the direction of the opening 64 of the housing 61. A sleeve (not shown) is mounted in the numeral wheel 63. In an unlocked state of the numeral wheel 63, the sleeve can be inward moved, while in a locked state, the sleeve can stop the fastener 70.

The fastener 70 is composed of a male fastener and female fastener. The fastener includes a first end 71 capable of entering the cavity 62 of the housing and legs 72 formed on the first end 71. This is similar to the male fastener 50 of the first embodiment. The fastener further includes a female fastener 73 connected with the first end 71. The female fastener 73 defines an internal cavity 74 for accommodating the controlling unit 40 therein. The fastener is formed with an opening 75 in which the male fastener 80 can be inserted. When the numeral wheel 63 is operated to the set number and unlocked, the sleeve can be axially moved, permitting the legs 72 of the first end 71 to be pressed toward each other and unlatched from the housing 61. This is identical to the aforesaid operation. The key can drive the controlling unit 40, permitting the male fastener 80 to be unlocked from the female fastener 73 as shown in FIG. 7.

Figure 8:
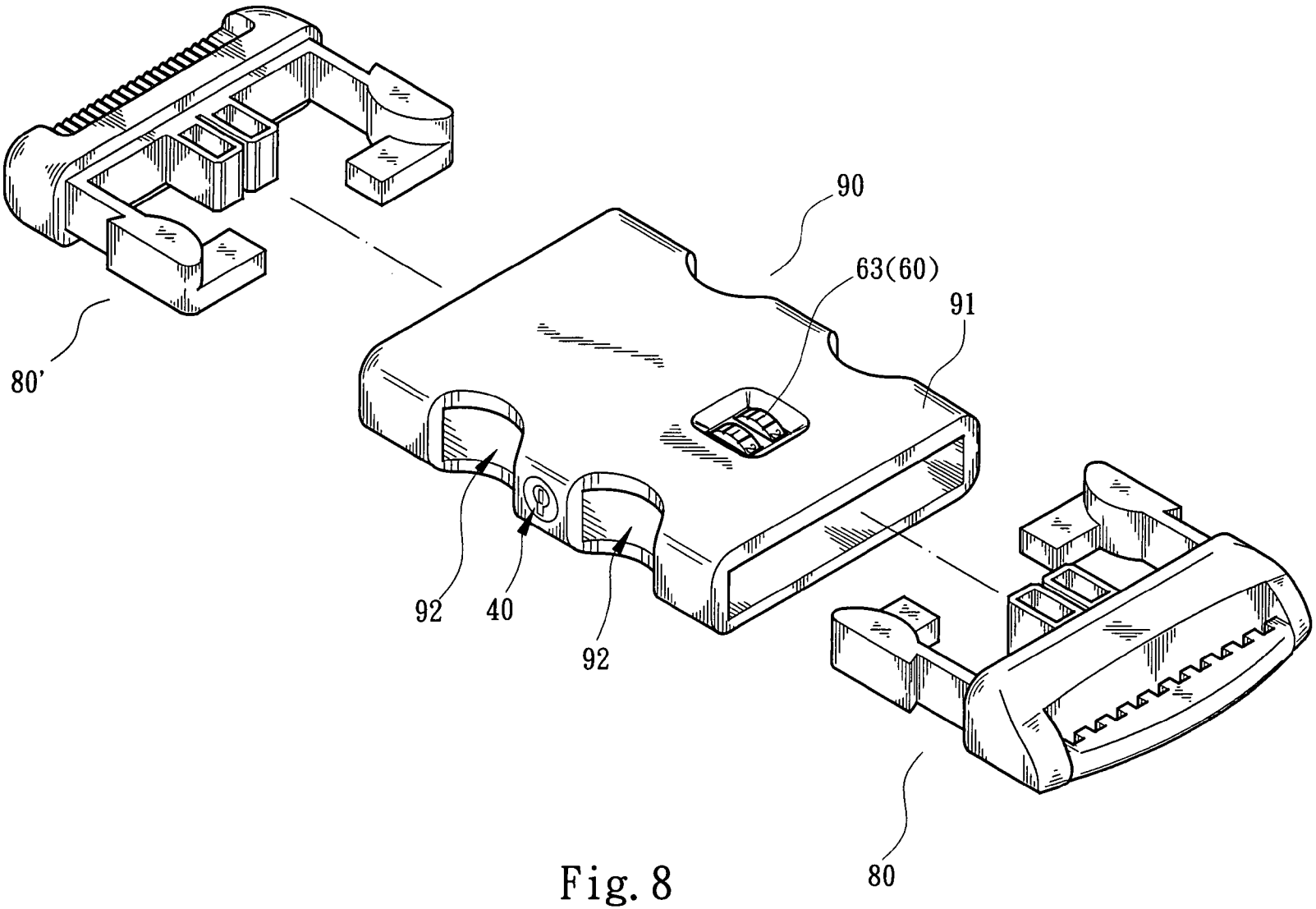
FIG. 8 shows a third embodiment of the present invention.

FIG. 8 shows a derived embodiment of the present invention, which includes a two-way modularized female fastener 90. The female fastener 90 has a housing 91 defining a cavity 92. The controlling unit 40 and the numeral wheel locking unit 60 are mounted in the cavity 92 for detaining the male fasteners 80, 80' as shown in FIG. 8.

The numeral wheel locking unit 60 and the key-driven controlling unit 40 are combined with the fasteners such as the female fasteners 30, 70 and male fasteners 50, 80, 80'. Such locking apparatus meets the regulation of U.S. customs without affecting or interfering with the original operation and function of the locking apparatus and fastener.

The above embodiments are only used to illustrate the present invention, not intended to limit the scope thereof. Many modifications of the above embodiments can be made without departing from the spirit of the present invention.

What is claimed is:

1. A locking apparatus combined with a fastener to control locking-unlocking thereof, the locking apparatus comprising a housing and a female fastener, the housing defining a cavity in which a locking unit is mounted, the female fastener defining a cavity in which a controlling unit is disposed, the locking unit including a numeral wheel for operating the locking unit into a locked state or an unlocked state to release a male fastener, the controlling unit including a rotary section, a reactor and a driven unit which are disposed on the rotary section, whereby a key is inserted into the rotary section to drive and rotate the rotary section, making the reactor and the driven unit rotated into an unlocked state to release one end of the male fastener, wherein the locking unit includes a valve block having a fixed end connected with a lock core of the numeral wheel, when the numeral wheel locking unit is in an unlocked state, the valve block being permitted to horizontally displace, whereby a free end of the valve block is disengaged from a wall of the housing, a resilient member being disposed on lower side of the fixed end to always support the valve block and permit the valve block to be perpendicularly disposed to lever a restricting section.

2. The locking apparatus combined with a fastener to control locking/unlocking thereof as claimed in claim 1, wherein the restricting section is pivotally connected with the housing and includes an arm for detaining the male fastener.

3. The locking apparatus combined with a fastener to control locking/unlocking thereof as claimed in claim 1, wherein the male fastener includes a first end, a shoulder section formed on the first end and a second end having legs which are detained by the female fastener, whereby the first end is inserted into an opening of the housing with the arm of the restricting section grasping the shoulder section of the first end.

* * * * *